US006207103B1

(12) United States Patent
Takajo et al.

(10) Patent No.: US 6,207,103 B1
(45) Date of Patent: Mar. 27, 2001

(54) FE-CR-SI STEEL SHEETS HAVING EXCELLENT CORROSION RESISTANCE AND METHOD FOR MANUFACTURING THE SAME

(75) Inventors: Shigeaki Takajo; Takako Yamashita; Akihiro Matsuzaki; Osamu Kondo, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/123,969

(22) Filed: Jul. 29, 1998

(30) Foreign Application Priority Data

Aug. 1, 1997 (JP) ..... 9-207732
Apr. 6, 1998 (JP) ..... 10-093180

(51) Int. Cl.[7] ..... C22C 38/18
(52) U.S. Cl. ..... 420/34; 420/36; 420/37; 420/38; 420/62; 420/63
(58) Field of Search ..... 420/36, 37, 38, 420/62, 63, 34

(56) References Cited

U.S. PATENT DOCUMENTS 4,360,381 * 11/1982 Tarutani et al. ..... 75/126

FOREIGN PATENT DOCUMENTS 0 570 985 11/1993 (EP) .
0 597 129 5/1994 (EP) .
0 625 584 11/1994 (EP) .
2 179 675 3/1987 (GB) .
56-146857 11/1981 (JP) .
57-134542 8/1982 (JP) .
01287253 * 11/1989 (JP) .
01172524 * 2/1996 (JP) .

* cited by examiner

*Primary Examiner*—Deborah Jones
*Assistant Examiner*—Lymarie Miranda
(74) *Attorney, Agent, or Firm*—Austin R. Miller

(57) ABSTRACT

Fe—Cr—Si steel sheet having an excellent corrosion resistance and high toughness and method for manufacturing the same; the amount of Cr is about 10–30 wt %, the total amount of C and N is not more than about 100 ppm and the remainder consists of Fe and incidental impurities; when a cast piece of this steel is subjected to hot rolling to roll into a thickness of not more than about 3 mm, the hot rolled sheet can be subjected to cold rolling or to warm rolling without annealing.

17 Claims, No Drawings

FE-CR-SI STEEL SHEETS HAVING EXCELLENT CORROSION RESISTANCE AND METHOD FOR MANUFACTURING THE SAME

FIELD OF THE INVENTION

The present invention relates to Fe—Cr—Si steel sheet having excellent corrosion resistance and high toughness, and to a method for manufacturing the same.

BACKGROUND OF THE INVENTION

Fe—Cr alloy sheets have been known for excellent corrosion resistance. To secure even more corrosion resistance and better heat resistance properties under far more severe conditions, various elements have been added to the alloys used in the sheets. Representative examples are Mo, Co and Al. As a result, quite excellent corrosion resistance has been achieved. Pitting corrosion potential is used as a representative index for corrosion resistance (as measured in a 3.5 vol % aqueous solution of NaCl at 30° C. at a current density of 10 $\mu A/cm^2$). With the added elements the pitting corrosion potential of the sheets can reach 500 mV or even higher. However, all of those elements are expensive. Accordingly, in the working industry, the added amount in the sheet is limited at a sacrifice of corrosion resistance and heat resistance.

Si is less expensive than Mo, Co or Al and, in addition, improves corrosion resistance or heat resistance. Accordingly, use of Fe—Cr—Si alloys in industry is expected. As an example Japanese Laid-Open Patent Publication Sho-57/134,542 discloses ferritic stainless steel containing 0.01–5.00 wt % of Si, 0.01–5.00 wt % of Mn and 0.20–1.00 wt % of Nb and having an excellent corrosion resistance.

Unfortunately, Si has the disadvantage that, when its content is about 3.5 wt % or more, toughness of the iron alloy is radically reduced. This limits its use as a material. Moreover, processing steps such as rolling and press forming become difficult. Further, it has been said that the effect of Si for improving corrosion resistance is inferior to that of Mo, Co, Al, etc. However, when the Si content is unduly restricted, its usefulness as an anticorrosive material for an Fe—Cr—Si alloy cannot be maintained.

It has been known that, in Fe—Cr alloy systems, reduction of impurities can sometimes improve toughness and processing ability without changing the main component system. A representative example is Japanese Laid-Open Patent Publication Hei-06/033,197 in which it is mentioned that, in some products, even when Si is present, processing ability can be improved by decreasing impurities. However, when a large amount of Si is present, there is a far more significant deterioration of toughness than is common in Fe—Cr alloys and there is concern that this deterioration cannot be compensated for by any degree of improvement of toughness of a common Fe—Cr alloy as disclosed in the patent. Further, it has not yet been investigated whether corrosion resistance can be kept as high as 500 mV, expressed as pitting corrosion potential.

In Japanese Laid-Open Patent Publication Hei-03/053,025, it is disclosed that when rapid cooling is conducted after hot rolling under high stress, the toughness of an Fe—Cr—Si alloy containing 0.01–0.50 wt % of rare earth metal elements (REM) can be improved. However, such a rolling process is not common and adds cost and delay. In addition, when the properties of the conventional Fe—Cr—Si alloy are taken into consideration, it is only to be expected that the resulting corrosion resistance will have to be less than 500 mV of pitting corrosion potential.

SUMMARY OF THE INVENTION

An object of the present invention is to overcome these barriers, and to create an Fe—Cr—Si alloy having excellent corrosion resistance and high toughness, and also to conduct cold rolling or hot rolling taking advantage of such high toughness.

We have found that, even in the case of a high content of Si, we can avoid reducing the amounts of C and N and Cr, as usually presumed to improve toughness, but, on the contrary, Cr in more than a certain amount is actually present, and that this achieves surprisingly high toughness. We have also found that, with regard to corrosion resistance, Cr and Si in more than certain amounts can be present while the contents of C and N are reduced, and that this achieves corrosion resistance at such a high level that it surpassed anything possible up to now.

DETAILED DESCRIPTION OF THE INVENTION

The present invention relates to Fe—Cr—Si steel sheet having excellent corrosion resistance and high toughness. The steel sheet comprises about 10–30 wt % of Cr and about 3.5–10 wt % of Si; the total amount of C and N in the sheet is not more than about 100 ppm, while the remainder comprises Fe and incidental impurities. When the total amount of C and N is about 40 ppm or less, very significant corrosion resistance and toughness is achieved.

Moreover, when not more than about 5 wt % of one or more metals selected from Mo, Co and Al is added to such a steel sheet, the corrosion resistance and toughness are further improved.

We have further found that, when the final thickness formed by hot rolling is less than about 3 mm, very high toughness or workability can be achieved, even if the amount of Si is as high as about 3.5–10 wt %. It has been also found that the greater the Cr, the more the advantageous effect.

The effect is significant when a cast ingot containing about 10–30 wt % of Cr and about 3.5–10 wt % of Si, where the total amount of C and N is not more than about 100 ppm and the remainder is mostly composed of iron and incidental impurities, is subjected to hot rolling to a thickness of not more than about 3 mm. The effect is promoted when not more than about 10 wt % of Ni is further added.

The sheet which is hot rolled to a thickness of not more than about 3 mm can surprisingly be subjected to cold rolling or warm rolling without annealing.

Experimental results whereby the present invention has been achieved will now be illustrated. They are not included to define or to limit the scope of the invention, which is defined in the appended claims.

Fe, Cr and Si each having a purity of at least 99.99% were used as materials. Each sample comprising 10 kg of highly pure Fe—Cr (0–30wt %)—Si (5wt %) alloy (wherein the weight percentage of Cr of each was either 0, 2, 10, 18 or 30%) was prepared by melting in a small melting furnace. For deoxidation, 0.01 wt % of Al was added. Amounts of the impurities in the resulting alloy were 1–4 ppm of C, 3–7 ppm of P, 3–5 ppm of S, 6–15 ppm of N, 5–11 ppm of 0 and 8–17 ppm of C and N.

Cast blocks were cut out at a thickness of 60 mm, heated at 1,100° C. and rolled into a sheet having a thickness of 3.5 mm. Charpy impact test specimens having a sheet thickness of 2.5 mm, a width of 10 mm, a length of 55 mm and a V notch of 2 mm were taken from each steel sheet in parallel to the rolling direction. Each was subjected to measurement of impact values at various temperatures. The temperature at which the percent brittle fracture became 50% (i.e. the ductile-brittle transition temperature) was determined and served as an index of toughness.

The transition temperature for each composition (0, 2, 10, 18 or 30 wt % of Cr and 5 wt % of Si) was as follows.

| Cr (wt%) | Transition Temperature (° C.) |
|---|---|
| 0 | +180 |
| 2 | +160 |
| 10 | −20 |
| 18 | −40 |
| 30 | −30 |

This unexpectedly shows that, when the amount of Cr is about 10 wt % or more, a very low transition temperature or, in other words, a very high toughness is achieved, ven if 5 wt % of Si is present.

Then, the composition Cr(18 wt %)—Si(5 wt %) was subjected to the same treatment as above except that iron nitride and mother alloy containing 5 wt % of C were used for the adjustment of C and N. The resulting alloy samples having various amounts of C and N, were subjected to a Charpy test in the same manner as above. The results were:

| C + N (ppm) | Transition Temperature (° C.) |
|---|---|
| 11 | −40 |
| 22 | −10 |
| 43 | +70 |
| 86 | +90 |
| 117 | +180 |

This shows that, when the amount of C plus N is about 100 ppm or less, toughness is markedly improved and that, when C plus N is about 40 ppm or less, toughness is drastically improved.

Those hot rolled sheets were made into thin sheets having a thickness of 0.35 mm by warm rolling, annealed at 850° C. in Ar for one minute and the corrosive properties were measured. The pitting corrosion potential in a 3.5 vol % aqueous solution of Nacl at 30° C., at a current density of 10 $\mu A/cm^2$, was used as an index of corrosion.

The result was as follows:

| C + N (ppm) | Pitting Corrosion Potential (mV) |
|---|---|
| 11 | 890 |
| 22 | 660 |
| 10 | 230 |
| 86 | 190 |
| 117 | 120 |

This shows that, when the amount of C and N was 30 ppm or less, the pitting corrosion potential was more than 500 mV (as compared to about 120 mV in the case of SUS 430) which is far better than ordinary ferritic stainless steel and is quite excellent against other corrosion resistant steels.

The selection of the component system and the purity of the alloy play important roles, as will become apparent.

Cr is a fundamental metal for improving alloy corrosion resistance. At least about 10 wt % of Cr is necessary for achieving very excellent corrosion resistance. In fact, Cr is very effective in achieving high toughness when the amount of Si is high; about 10 wt % or more is necessary for such a purpose as well. On the other hand, when the Cr amount is more than about 30 wt %, the effect becomes saturated and also rather deteriorates the workability of the steel. Further, it increases cost. Therefore, the content of Cr is regulated as about 10–30 wt %. Preferably, it is about 10–25 wt % or, more preferably, about 10–20 wt %.

Si is also an element for improving corrosion resistance and heat resistance. When its amount is less than about 3.5 wt %, very excellent corrosion resistance is not achieved. When it is above about 10 wt %, high toughness is not secured. Accordingly, the amount of Si is regulated as about 3.5–10 wt %. Preferably, it is about 3.5–8 wt % or, more preferably, about 4–7 wt %.

C and N deteriorate the toughness of the Fe—Cr—Si alloy. In order to secure the high toughness, their total amount is to be not more than about 100 ppm. Preferably, it is not more than about 40 ppm or, more preferably, not more than about 20 ppm.

It has been known that Mo, Co and Al give more corrosion resistance and heat resistance when they are added to alloys of an Fe—Cr type. Addition of those elements does not alter the essential feature of the present invention, although an increase in cost results if they are added in large amounts. Therefore, the upper limit is about 5 wt %. Preferably, it is not more than about 3 wt % or, more preferably, not more than about 1.5 wt %.

Addition of other elements than the above-mentioned ones for improvement of corrosion resistance such as Mo, Co and Al does not deteriorate workability. However, addition of too much causes a problem in terms of cost and, moreover, improvement in characteristics becomes saturated. Accordingly, each of them is to be not more than 5 wt %. Preferably, the amounts will be about 0.03–3.0 wt % for Mo, about 0.03–3.0 wt % for Co and about 0.5–5.0 wt % for Al.

With regard to the amount of impurities in the steel material, it is preferred that the total amount of C and N is not more than about 100 ppm and the total amount of C, N, O, S and P is not more than about 160 ppm. The amount of Mn is preferably not more than 0.2 wt %.

In the manufacture of an Fe—Cr—Si alloy having very high corrosion resistance and high toughness at the level of the present invention, it is preferred to use highly pure electrolytic iron, electrolytic chromium and silicon metal having a purity of not lower than about 99.9% or, preferably, not lower than about 99.99%. When Mo, Co and Al are added, highly pure materials are used. Melting is conducted using a vacuum melting furnace of a high vacuum (pressure of not higher than $10^{-4}$ Torr) and a small amount of Al is added for deoxidation. After that, hot rolling may be conducted under conventional conditions. Since the toughness is very high, the product may be further subjected to cold rolling to give a thin sheet. Annealing and surface finish treatment after that may be conducted by the same steps as those in the case of conventional ferritic stainless steel sheets. There is no particular limitation for the amount of impurities other than C and N but, preferably, P is not more than about 40 ppm, S is not more than about 20 ppm and O is not more than about 50 ppm and the total amount of C, N, P, S and O is preferably not more than about 160 ppm.

Now, the result of experiments concerning the rolling method will be explained as follows.

10 kg of Fe—Cr(18 wt %)—Si(5 wt %) alloy was manufactured by melting in a small vacuum melting furnace of an experimental scale. Deoxidation was conducted by Al; iron nitride and mother alloy containing 5 wt % of C were added to adjust the amounts of C and N; and the amounts of the impurities were 21 ppm of C, 0.01% of Mn, 4 ppm of P, 3 ppm of S, 52 ppm of N, 15 ppm of 0 and 30 ppm of Al. After removing the scales of the steel blocks, the alloy was heated at 1,100° C. and rolled into a plurality of sheets having thicknesses of 5.0, 4.0, 2.0 or 1.5 mm. Charpy impact test specimens having a sheet thickness of 1.0 mm, a width of 10 mm, a length of 55 mm and a V notch of 2 mm were taken from each steel sheet in parallel to the rolling direction. Each sheet was subjected to measurement of impact values at various temperatures, whereupon the temperature where the percent brittle fracture became 50%, i.e. the ductile-brittle transition temperature, was determined as an index of toughness. The transition temperature for each thickness was as follows.

| Final Thickness upon Hot Rolling (mm) | Transition Temperature (C.°) |
|---|---|
| 5.0 | +110 |
| 4.0 | +100 |
| 3.0 | +70 |
| 2.0 | −10 |
| 1.5 | −40 |

This establishes that, when the final thickness was about 3 mm or less, high toughness was achieved. When the final thickness of hot rolling was about 2 mm or less, it was also possible to conduct cold rolling after that step.

The experimental facts show that not only the component systems and purity but also final thickness after hot rolling play an important role.

When the final thickness after hot rolling is controlled to not more than about 3 mm, it is possible to quickly improve toughness. This is believed to be due to the fact that the dislocation introduced upon hot rolling remains without relaxation by a sudden decrease of sheet thickness forming fine subgrains. The fact was confirmed by observing a specimen having a final thickness of 1.5 mm after hot rolling under a thin-film transmission electron microscope. Accordingly, the final thickness is preferably regulated to be not more than about 3 mm. This value corresponds to a reduction in thickness of not less than about 85%.

When less than about 10 wt % Ni is added, toughness is improved as a result of fine grain size, and corrosion resistance is favorably affected. However, when the amount is more than about 10 wt %, the effect becomes saturated. Also, it causes an increase of cost. The upper limit content of Ni is about 10 wt %, preferably about 5 wt %. In order to secure the effects of Ni stated above, about 0.5 wt % or more Ni is necessary. Therefore, the preferable content of Ni is regulated as about 0.5–5.0 wt %.

However, those effects are lost when annealing is conducted. This is believed to be due to the fact that the fine subgrains are relaxed by recrystallization. Therefore, it is preferred to avoid annealing after hot rolling for securing high toughness. Accordingly, it is preferred that the hot rolled sheet of Fe—Cr—Si steel is not annealed but is subjected to cold rolling or warm rolling to give the Fe—Cr—Si steel sheet. The term "warm" used here stands for a temperature range of about 50–350° C.

This invention will be illustrated by the following examples, which are intended as illustrative, but are not intended to define or limit the scope of the invention.

EXAMPLES 1

Electrolytic iron and electrolytic chromium having purity of 99.99%, silicon metal having a purity of 99.999% and aluminum metal, cobalt metal and molybdenum metal having purity of 99.99% were used as materials and melted in a small melting furnace of a high vacuum ($1\times10^{-4}$ Torr) to prepare each 10 kg of the alloy as shown in Table 1. When no Al was contained as a main component, aluminum foil in an amount corresponding to 0.01 wt % (1 g) after defatting was added for deoxidation. The cast blocks were cut out in a size of 40×60×100 mm, heated in Ar at 1,100° C., kept at that temperature for 30 minutes, the size of 60 mm was roughly rolled to 20 mm, then re-heated at 1,100° C., kept at that temperature for 15 minutes and rolled into the sheet thickness of 3.5 mm.

Charpy impact test specimens having a sheet thickness of 2.5 mm, width of 10 mm, length of 55 mm and a V notch of 2 mm were taken from each steel sheet in parallel to the rolling direction and subjected to a measurement of Charpy impact values at the temperatures with intervals of 25° C. whereupon the temperature where the percent brittle fracture became 50%, i.e. ductile-brittle transition temperature, was determined as an index for the toughness.

Then the surface of the hot rolled sheet having a thickness of 3.5 mm was shot-blasted and subjected to a cold rolling to an extent of 0.35 mm. Incidentally, when the transition temperature was higher than the room temperature, it was preheated at 300° C. to conduct warm rolling. After that, the thin sheet was annealed in Ar at 850° C. for one minute and pitting corrosion potential was measured in a 3.5 vol % aqueous solution of NaCl at 30° C. at a current density of 10 $\mu A/cm^2$.

Table 2 shows the transition temperatures of various types of steel, method of rolling (whether cold or warm) and pitting corrosion potentials.

Type 1 is a comparative example where the percentage Cr was insufficient and both toughness and corrosion resistance were inferior to those of ordinary stainless steel. Type 2 was within a composition range of the present invention and had both very high toughness and very high corrosion resistance. Type 3 is a comparative example where Si was insufficient and, although the toughness was excellent, corrosion resistance was at a level of ordinary SUS304 and SUS430. In Type 4, the amount of Si was excessive, whereby toughness was deteriorated.

Types 5 and 6 are present inventions where Al, Co and Mo were further added to the present invention and both alloys showed very high toughness and corrosion resistance.

Types 7 and 8 contained more C and N than Type 2 and, especially in Type 8, the amount of C and N was so high as being beyond the coverage of the present invention. The resulting toughnesses and corrosion resistances were similar to those of Type 1 containing low Cr and high Si. When the amount of C and N was excessive as compared with Type 2, both toughness and corrosion resistance were deteriorated.

Type 9 is a present invention where the purity was made higher within the range of the present invention, and both toughness and corrosion resistance were further improved affording a very excellent corrosion resistance materials.

TABLE 1

| Type | C ppm | Si % | Mn % | P ppm | S ppm | Cr % | Al % | N ppm | O ppm | C + N ppm | Others % | Remarks |
|---|---|---|---|---|---|---|---|---|---|---|---|---|
| 1 | 4 | 5.0 | 0.005 | 4 | 3 | 2.0 | 0.007 | 7 | 11 | 11 | — | ** |
| 2 | 3 | 5.1 | 0.004 | 3 | 4 | 17.8 | 0.009 | 9 | 10 | 12 | — | * |
| 3 | 3 | 2.9 | 0.006 | 4 | 5 | 18.0 | 0.008 | 10 | 10 | 13 | — | ** |
| 4 | 3 | 10.8 | 0.003 | 3 | 4 | 17.9 | 0.005 | 8 | 13 | 11 | — | ** |
| 5 | 1 | 4.6 | 0.005 | 3 | 4 | 18.1 | 1.3 | 9 | 9 | 10 | — | * |
| 6 | 5 | 4.5 | 0.008 | 6 | 6 | 18.0 | 0.006 | 11 | 13 | 16 | # | * |
| 7 | 32 | 5.0 | 0.006 | 5 | 4 | 18.0 | 0.005 | 11 | 9 | 43 | — | * |
| 8 | 49 | 5.0 | 0.08 | 3 | 2 | 18.3 | 0.02 | 68 | 10 | 117 | — | ** |
| 9 | 1 | 4.9 | 0.002 | 2 | 3 | 17.8 | 0.010 | 4 | 4 | 5 | — | * |

*: Example of the present invention
**: Comparative Example
#: Mo: 1.5; Co: 0.8

TABLE 2

| Type | Transition Temp (° C.) | Cold/Warm Rolling | Pitting Corrosion Potential (mV) | Remarks |
|---|---|---|---|---|
| 1 | +160 | Warm | 10 | ** |
| 2 | −40 | Cold | 890 | * |
| 3 | −40 | Cold | 310 | ** |
| 4 | +190 | Warm | 900 | ** |
| 5 | −50 | Cold | >1000 | * |
| 6 | −50 | Cold | >1000 | * |
| 7 | +70 | Warm | 230 | * |
| 8 | +180 | Warm | 120 | ** |
| 9 | −80 | Cold | >1000 | * |

*: Example of the present invention
**: Comparative Example

EXAMPLE 2

Each 10 kg of alloy as shown in Table 3 was melted using a small vacuum melting furnace of an experimental scale. Deoxidation was conducted by Al; iron nitride and mother alloy containing 5 wt % of Fe were added to adjust the amount of C and N; and the amounts of impurities were 10–30 ppm of C, 0.01% of Mn, 8–10 ppm of P, 5–10 ppm of S, 50–70 ppm of N, 30 ppm of Al and 10–30 ppm of O. The steel block was cut in a size of 40×60×100 mm, heated in Ar at 1,100° C., kept at that temperature for 30 minutes, subjected to rough hot rolling to reduce 60 mm into 20 mm, re-heated at 1,100° C., kept at that temperature for 15 minutes and rolled to a thickness of 4.0, 3.0, 2.0 or 1.5 mm.

Charpy impact test specimens having a sheet thickness of 1.0 mm, width of 10 mm, length of 55 mm and a V notch of 2 mm were taken from each steel sheet in parallel to the rolling direction and subjected to a measurement of Charpy impact values at the temperatures with intervals of 25° C. whereupon the temperature where the percent brittle fracture became 50%, i.e. ductile-brittle transition temperature, was determined as an index of toughness.

Then the surface of each of the hot rolled sheets having a certain thickness was treated with shot blast and subjected to a cold rolling to an extent of 0.35 mm. Incidentally, if the transition temperature was higher than the room temperature, it was preheated at 300° C. to conduct warm rolling. The sheet after rolling was observed under a microscope to determine whether it was cracked or not and used as an index for cold or warm rolling property.

Table 3 shows final thicknesses after hot rolling, transition temperature and cold rolling properties for each type of steel sheet.

In Types A and B, there was a major difference of toughness between the case where final thickness in hot rolling was regulated to 3 mm or less, and the opposite case, whereby it was clearly established that, when rolling within the requirement of the present invention was conducted, toughness was significantly improved. In addition, in the steel types satisfying the requirements of the present invention, cold rolling is possible.

Although Type C contained a high amount of Si, its Cr content was about 18 wt % and its final thickness in hot rolling was 2 mm whereupon a transition temperature of 50° C. was secured. In Types D–F, elements such as Ni, Mo, Al and Co were added for achieving corrosion resistance but, as a result of subjecting to hot rolling to 2 mm, no deterioration of toughness was present in any of them.

In Types G and H, the amount of Si was too much and, therefore, toughness deteriorated.

In accordance with the present invention, it is now possible to achieve better corrosion resistance together with higher toughness than conventional ordinary stainless steel (such as SUS430 and SUS304). Moreover, the alloy cost can be kept surprisingly low. When the steps subsequent to rolling are also taken into consideration, the present invention has created a very excellent anticorrosive material.

TABLE 3

| | Chemical Compositions (wt %) | | | | Characteristics of material | | | |
|---|---|---|---|---|---|---|---|---|
| Type | Si 3.5 to 10 wt %* | Cr 10 to 30 wt %* | Ni, Mo, Co, Al | C + N ppm | Thickness (mm) | TT (° C.) | Cold | Warm |
| A** | 5.1 | 18.0 | — | 78 | 1.5 | −110 | ○ | ○ |
| B*** | 5.1 | 18.2 | — | 83 | 3.5 | 150 | x | ○ |
| C** | 6.5 | 17.5 | — | 88 | 2.0 | 50 | x | ○ |
| D** | 5.0 | 17.8 | Al(1.3) | 66 | 2.0 | 25 | ○ | ○ |

TABLE 3-continued

| | Chemical Compositions (wt %) | | | | Characteristics of material | | | |
|---|---|---|---|---|---|---|---|---|
| Type | Si 3.5 to 10 wt %* | Cr 10 to 30 wt %* | Ni, Mo, Co, Al | C + N ppm | Thickness (mm) | TT (° C.) | Cold | Warm |
| E** | 6.5 | 17.5 | Ni(8.0) | 70 | 2.0 | 25 | ○ | ○ |
| F** | 5.1 | 17.8 | Mo(1.5)Co(0.8) | 79 | 2.0 | 25 | ○ | ○ |
| G*** | 10.8 | 17.9 | — | 84 | 3.5 | 250 | x | x |
| H*** | 11.0 | 15.0 | — | 81 | 2.0 | 200 | x | x |

*: Within the present invention
**: Example of the present invention
***: Comparative Example
Thickness: Final thickness upon hot rolling
TT: Transition temperature

What is claimed is:

1. Steel sheet comprising Fe, Cr and Si, wherein:

the content of Cr is about 10–30 wt %, the content of Si is about 3.5–10 wt %, the total content of C and N is not more than about 100 ppm, the remainder of said sheet comprises Fe and incidental impurities, and said steel sheet having a corrosion resistance index of at least about 500 mV, expressed as pitting corrosion potential in a 3.5 vol % aqueous solution of NaCl at 30° C. at a current density of 10 $\mu A/cm^2$.

2. Steel sheet according to claim 1 in which the total content of C plus N is not more than about 40 ppm.

3. Steel sheet according to claim 1 in which said sheet further comprises one or more elements selected from the group consisting of Mo, Co and Al, each being present in an amount of about 5 wt % or less.

4. Steel sheet according to claim 1, made from a cast ingot subjected to a hot rolling, and has to a thickness of not more than about 3 mm.

5. Steel sheet according to claim 4 in which said sheet further comprises not more than about 10 wt % of Ni.

6. Steel sheet defined in claim 1, wherein the content of Cr is about 10–25 wt %.

7. Steel sheet defined in claim 1, wherein the content of Cr is about 10–20 wt %.

8. Steel sheet defined in claim 1, wherein the content of Si is about 3.5–8 wt %.

9. Steel sheet defined in claim 1, wherein the content of Si is about 4–7 wt %.

10. Steel sheet defined in claim 3, wherein the total content of C plus N is about 40 ppm or less.

11. Steel sheet defined in claim 1, wherein the total content of C plus N is about 20 ppm or less.

12. Steel sheet defined in claim 1, wherein the total content of C, N, O, S and P is about 160 ppm or less.

13. Steel sheet defined in claim 5, wherein the amount of Ni is about 0.5–5.0 wt %.

14. Steel sheet defined in claim 3, wherein the amount of Mo is about 0.3–0.03 wt %.

15. Steel sheet defined in claim 3, wherein the amount of Co is about 0.3–0.03 wt %.

16. Steel sheet defined in claim 3, wherein the amount of Al is about 0.5–5.0 wt %.

17. Steel sheet defined in claim 1, wherein the amount of Mn is about 0.2 wt % or less.

* * * * *